US006159921A

United States Patent [19]

Desai et al.

[11] Patent Number: 6,159,921

[45] Date of Patent: Dec. 12, 2000

[54] DYE TRANSFER INHIBITION SYSTEM

[75] Inventors: Sureshchandra G. Desai, Wayne, N.J.; Michael Hansberry, Plymouth Meeting, Pa.; George A. Smith, Newtown, Pa.; Charles B. Allen, East Norriton, Pa.; J. Frederick Hessel, Doylestown, Pa.

[73] Assignee: Henkel Corporation, Gulph Mills, Pa.

[21] Appl. No.: 08/808,581

[22] Filed: Feb. 28, 1997

[51] Int. Cl.[7] ..... C11D 14/02; C11D 15/00; C11D 17/00

[52] U.S. Cl. ..... 510/352; 510/276; 510/350; 510/351; 510/499

[58] Field of Search ..... 510/276, 327, 510/328, 340, 341, 351, 352, 499, 537, 350

[56] References Cited

U.S. PATENT DOCUMENTS

| | | | |
|---|---|---|---|
| 3,676,338 | 7/1972 | Fries et al. | 252/8.75 |
| 4,756,849 | 7/1988 | Weber et al. | 252/542 |
| 5,109,127 | 4/1992 | Sekiguchi et al. | 536/115 |
| 5,174,927 | 12/1992 | Honsa | 252/543 |
| 5,190,747 | 3/1993 | Sekiguchi et al. | 424/56 |
| 5,223,179 | 6/1993 | Connor et al. | 252/548 |
| 5,266,690 | 11/1993 | McCurry, Jr. et al. | 536/18.6 |
| 5,310,542 | 5/1994 | Au et al. | 424/52 |
| 5,332,528 | 7/1994 | Pan et al. | 252/548 |
| 5,338,491 | 8/1994 | Connor et al. | 252/548 |
| 5,352,386 | 10/1994 | Rahman et al. | 252/548 |
| 5,352,387 | 10/1994 | Rahman et al. | 252/548 |
| 5,358,656 | 10/1994 | Humphreys et al. | 252/174.12 |
| 5,451,337 | 9/1995 | Liu et al. | 252/102 |
| 5,776,872 | 7/1998 | Giret et al. | 510/124 |

FOREIGN PATENT DOCUMENTS

| | | |
|---|---|---|
| 550279A1 | 7/1993 | European Pat. Off. . |
| 550280A1 | 7/1993 | European Pat. Off. . |
| 550281A2 | 7/1993 | European Pat. Off. . |

*Primary Examiner*—Yogendra Gupta
*Assistant Examiner*—Gregory E. Webb
*Attorney, Agent, or Firm*—John E. Drach; Steven J. Trzaska

[57] ABSTRACT

A detergent composition comprising: (a) an alkali component selected from the group consisting of sodium hydroxide, sodium carbonate, monoethanolamine, diethanolamine, triethanolamine, and mixtures thereof; and (b) a dye transfer inhibition additive selected from the group consisting of: (i) a sugar surfactant selected from the group consisting of an alkyl polyglycoside having general formula (I)

$$R_1O(Z)_aI$$

wherein $R_1$ is a monovalent organic radical having from about 6 to about 30 carbon atoms; Z is a saccharide residue having 5 or 6 carbon atoms; a is a number having a value from 1 to about 6, an alkyl glucose ester, an aldobionamide, a gluconamide, a glyceramide, a glyceroglycolipid, a polyhydroxy fatty acid amide and mixtures thereof; (ii) an alkyl sulfate; (iii) an aminocarboxylic acid amphoteric surfactant; and (iv) mixtures of (i), (ii), and (iii).

17 Claims, No Drawings

DYE TRANSFER INHIBITION SYSTEM

FIELD OF THE INVENTION

The present invention generally relates to inhibiting the transfer of fugitive dyes during laundry washing. More particularly, by employing a nonionic sugar surfactant, an ether sulfate, or an aminocarboxylic acid amphoteric surfactant in a detergent formulation, dye transfer between dyed fabrics can be successfully inhibited during the washing process.

BACKGROUND OF THE INVENTION

One of the most persistent and troublesome problems arising during modern fabric laundering operations is the tendency of some colored fabrics to release dye into the laundering solutions. The dye is then transferred onto other fabrics being washed therewith.

One way of over coming this problem would be to bleach the dyes washed out of dyed fabrics before they have the. opportunity to become attached to other articles in the wash.

Suspended or solubilized dyes can to some degree be oxidized in solution by employing known bleaching agents. However, it is important at the same time not to bleach the dyes actually remaining on the fabrics, that is, not to cause color damage.

Other solutions to this dye transfer problem include: (1) the use of an oxidizing bleaching agent together with catalytic compounds such as iron porphins; (2) the use of peroxidases and oxidases for the oxidation of organic or inorganic substances, including colored substances; (3) the use of an enzymatic system capable of generating hydrogen peroxide and iron catalysts; (4) the use of an additive capable of exerting a bleaching effect containing various enzymes such as peroxidase, lipase, protease, amylase and cellulase; and (5) the use of polymers such as polyvinyl pyrrolidone which encapsulate dye.

While the use of such compounds as polyvinyl pyrrolidone may serve to inhibit dye transfer to some extent, these components lend nothing to the detergency (cleaning) properties of the detergent compositions in which they are present.

It has been surprisingly found, however, that by employing specific surfactants as additives in a laundry detergent composition, both dye transfer inhibition and improved detergency properties may be obtained.

SUMMARY OF THE INVENTION

The present invention is directed to a detergent composition containing:

(a) an alkali component selected from the group consisting of sodium hydroxide, sodium carbonate, monoethanolamine, diethanolamine, triethanolamine, and mixtures thereof; and (b) a dye transfer inhibition additive selected from the group consisting of:

(i) a sugar surfactant selected from the group consisting of an alkyl polyglycoside having general formula (I)

$$R_1O(Z)_a \quad \text{I}$$

wherein $R_1$ is a monovalent organic radical having from about 6 to about 30 carbon atoms; Z is a saccharide residue having 5 or 6 carbon atoms; a is a number having a value from 1 to about 6, an alkyl glucose ester, an aldobionamide, a gluconamide, a glyceramide, a glyceroglycolipid, a polyhydroxy fatty acid amide and mixtures thereof;

(ii) an alkyl sulfate;

(iii) an aminocarboxylic acid amphoteric surfactant; and (iv) mixtures of (i), (ii), and (iii).

The present invention is also directed to a process for inhibiting the transfer of fugitive dyes onto textile substrates during laundering involving contacting the textile substrates, in an aqueous bath, with a dye transfer inhibition additive selected from the group consisting of:

(i) a sugar surfactant selected from the group consisting of an alkyl polyglycoside having general formula (I)

$$R_1O(Z)_a \quad \text{I}$$

wherein $R_1$ is a monovalent organic radical having from about 6 to about 30 carbon atoms; Z is a saccharide residue having 5 or 6 carbon atoms; a is a number having a value from 1 to about 6, an alkyl glucose ester, an aldobionamide, a gluconamide, a glyceramide, a glyceroglycolipid, a polyhydroxy fatty acid amide and mixtures thereof;

(ii) an alkyl sulfate;

(iii) an aminocarboxylic acid amphoteric surfactant; and (iv) mixtures of (i), (ii), and (iii).

DESCRIPTION OF THE INVENTION

Other than in the operating examples, or where otherwise indicated, all numbers expressing quantities of ingredients or reaction conditions used herein are to be understood as being modified in all instances by the term "about".

The dye transfer inhibition additive of the present invention comprises either a nonionic sugar surfactant, an anionic alkyl sulfate, an aminocarboxylic acid amphoteric surfactant or mixtures thereof.

In the event that a sugar surfactant is employed as the dye inhibition additive, it may be selected from the group consisting of an alkyl polyglycoside having general formula (I)

$$R_1O(Z)_a \quad \text{I}$$

wherein $R_1$ is a monovalent organic radical having from about 6 to about 30 carbon atoms; Z is a saccharide residue having 5 or 6 carbon atoms; a is a number having a value from 1 to about 6, an alkyl glucose ester, an aldobionamide, a gluconamide, a glyceramide, a glyceroglycolipid, a polyhydroxy fatty acid amide and mixtures thereof.

The alkyl polyglycoside which may be employed in the present invention corresponds to general formula I:

$$R_1O(Z)_a \quad \text{I}$$

wherein $R_1$ is a monovalent organic radical having from about 6 to about 30 carbon atoms; Z is a saccharide residue having 5 or 6 carbon atoms; a is a number having a value from 1 to about 6. The alkyl polyglucosides which can be used in the compositions and processes according to the invention are commercially available, for example, as APG® surfactants, GLUCOPON® surfactants, AGRIMUL® surfactants, or PLANTAREN® surfactants from Henkel Corporation, Ambler, Pa. 19002. Examples of such surfactants include but are not limited to:

1. GLUCOPON® 225 Surfactant—an alkylpolyglycoside in which the alkyl group contains 8 to 10 carbon atoms and having an average degree of polymerization of 1.7.
2. APG® 425 Surfactant—an alkyl polyglycoside in which the alkyl group contains 8 to 16 carbon atoms and having an average degree of polymerization of 1.6.
3. APG® 625 Surfactant—an alkyl polyglycoside in which the alkyl group contains 12 to 16 carbon atoms and having an average degree of polymerization of 1.6.

4. APG® 300 Surfactant—an alkyl polyglycoside substantially the same as APGO 325 Surfactant but having an having an average degree of polymerization of 1.4.
5. APG® 325 Surfactant—an alkyl polyglycoside in which the alkyl group contains 9 to 11 carbon atoms and having an average degree of polymerization of 1.5.
6. GLUCOPON® 600 Surfactant—an alkyl polyglycoside in which the alkyl group contains 12 to 16 carbon atoms and having an average degree of polymerization of 1.4.
7. PLANTAREN® 2000 Surfactant—an alkyl polyglycoside in which the alkyl group contains 8 to 16 carbon atoms and having an average degree of polymerization of 1.4.
8. PLANTAREN® 1300 Surfactant—an alkyl polyglycoside in which the alkyl group contains 12 to 16 carbon atoms and having an average degree of polymerization of 1.6.
9. GLUCOPON® 220 Surfactant—an alkyl polyglycoside in which the alkyl group contains 8 to 10 carbon atoms and having an average degree of polymerization of 1.4.

Other examples include alkyl polyglycoside surfactant compositions which are comprised of mixtures of compounds of formula I wherein Z represents a moiety derived from a reducing saccharide containing 5 or 6 carbon atoms; a is zero; and $R_1$ is an alkyl radical having from 8 to 20 carbon atoms. The composition is characterized in that it has increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglucosides, can be prepared by separation of the monoglycoside from the original reaction mixture of alkyl monoglycoside and alkyl polyglycosides after removal of the alcohol. This separation may be carried out by molecular distillation and normally results in the removal of about a 70–95% by weight of the alkyl monoglycosides. After removal of the alkyl monoglycosides, the relative distribution of the various components, mono- and poly-glycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

Preferred alkyl polyglycosides are those in which the alkyl groups contains from 8 to 18 carbon atoms and having an average degree of polymerization of 1.0 to 2.0. The most preferred alkyl polyglycosides are those which have alkyl groups containing 8 to 16 carbon atoms and having an average degree of polymerization of 1.3–1.8. The alkyl groups can be based on both natural and synthetic raw materials.

The alkyl glucose ester sugar cosurfactants are generally disclosed in U.S. Pat. Nos. 5,109,127 and 5,190,747, the entire contents of both being incorporated herein by reference. These sugar cosurfactants have the general formula:

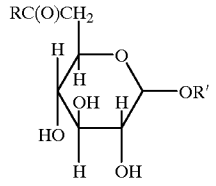

wherein R represents a fatty acid residue of 6 to 20 carbon atoms, preferably 6 to 12 carbon atoms and $R^1$ represents an alkyl group having 2 to 6 carbon atoms. Representative examples of such alkyl glucose esters are 1-ethyl-6-caprylglucoside, 1-ethyl-6-laurylglucoside, 1-butyl-6-caprylglucoside, 1-ethyl-6-palmitylglucoside and 1-ethyl-6-oleylglucoside.

The aldobionamide sugar cosurfactants are generally disclosed in U.S. Pat. No. 5,310,542 and in published European Patent Application No. 550,281, both of which are incorporated herein by reference. An aldobionamide is generally defined as the amide of an aldobionic acid or aldobionolactone and an aldobionic acid in turn is defined as a sugar substance (e.g. any cyclic sugar) in which the aldehyde group has been replaced by a carboxylic acid which upon drying is capable of cyclizing to form an aldonolactone. The aldobionamides can be based on compounds comprising two saccharide units, e.g. lactobionamides, maltobionamides, cellobionamides, melibionamides, or gentiobionamides, or they can be based on compounds comprising more than two saccharide units provided that the polysaccharide has a terminal sugar unit with an aldehyde group available.

The preferred aldobionamides of the present invention are lactobionamides of the formula

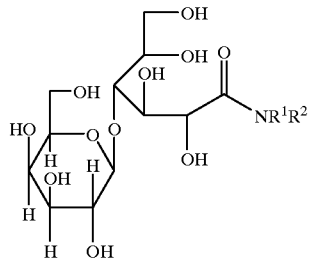

wherein $R^1$ and $R^2$ are the same or different and are selected from hydrogen and an aliphatic hydrocarbon radical containing up to about 36 carbon atoms (e.g. alkyl groups and alkenyl groups which groups may also include a heteroatom such as N, O, S, present, for instance, as an amide, carboxy, ether and/or saccharide moiety) except that $R^1$ and $R^2$ cannot simultaneously be hydrogen. The aliphatic hydrocarbon radical preferably contains up to 24 carbon atoms, most preferably from 8 to 18 carbon atoms. Representative examples of such lactobionamides are N-propyl lactobionamide, N-pentyl lactobionamide, N-decyl lactobionamide, N-hexadecyl lactobionamide, N-oleyl lactobionamide, N-dodecyl-N-methyl lactobionamide, and N-dodecyloxypropyl lactobionamide.

The gluconamide sugar cosurfactants are generally disclosed in U.S. Pat. No. 5,352,386, the entire contents of which is incorporated herein by reference. These cosurfactants have the general formula:

$$HOCH_2—(CHOH)_m—C(O)—NHR$$

wherein m is an integer from 2 to 5; and R is a straight or branched, saturated or unsaturated aliphatic hydrocarbon having 4 to about 24 carbon atoms, preferably 8 to 24 carbon atoms, which R group can also contain a heteroatom selected from the group consisting of oxygen, nitrogen and sulfur. Representative examples of such cosurfactants are N-octylerythronamide, N-decylerythronamide, N-dodecylerythronamide, N-tetradecylerythronamide, N-decylxylonamide and N-dodecylxylonamide.

The glyceramide sugar cosurfactants are generally disclosed in U.S. Pat. No. 5,352,387, the entire contents of which is incorporated herein by reference. These cosurfactants have the general formula:

$$HOCH_2CH(OH)C(O)NHR$$

wherein R is a $C_8$ to $C_{24}$ straight or branched chained, saturated or unsaturated aliphatic hydrocarbon in which the R group may also be substituted by a heteroatom selected from oxygen, nitrogen and sulfur. Representative examples of such cosurfactants are N-octylglyceramide, N-decylglyceramide and N-hexadecylglyceramide.

The glyceroglycolipid sugar cosurfactants are generally disclosed in U.S. Pat. No. 5,358,656 and published European Patent Application No. 550,279, the disclosure of each of which is incorporated herein by reference. The glyceroglycolipids can be of the formula:

$$A^1—O—CH_2—CH(B)—CH_2NRR_1$$

wherein $A^1$ is a saccharide, preferably having one or more saccharide units, more preferably a mono or disaccharide and most preferably a monosaccharide such as glucose or galactose; R and $R_1$ are the same or different and are hydrogen, a branched or unbranched hydrocarbon radical having from 1 to about 24, preferably from about 6 to about 18 carbon atoms; B is OH or a $NR^2R^3$ group, wherein $R^2$ and $R^3$ may be the same or different and are hydrogen, a branched or unbranched hydrocarbon radical having 1 to 24, preferably from 6 to 18 carbon atoms, and $NRR_1$ and B are positionally interchangeable. Representative examples of such cosurfactants are 3-(butylamino)-2-hydroxypropyl-β-D-galactopyranoside, 3-(octylamino)-2-hydroxypropyl-β-D-galactopyranoside, 3-(eicosylamino)-2-hydroxypropyl-β-D-galactopyranoside, 3-(butylamino)-2-hydroxypropyl-β-D-glucopyranoside, and 3-(pentylamino)-2-hydroxypropyl-β-D-mannopyranoside.

Other glyceroglycolipid cosurfactants are disclosed in published European Patent Application No. 550,280, which is incorporated herein by reference. These cosurfactants are of the formula:

$$A^1—O—CH_2—CH(OR_1)—CH_2OR$$

wherein $A^1$ is from 1 to 4 saccharide units and more preferably represents a mono or disaccharide, and most preferably a monosaccharide, for example, glucose or galactose; R and $R_1$ are the same or different and are hydrogen, or a branched or unbranched, saturated or unsaturated, hydrocarbon radical having from 1 to 24 carbon atoms, preferably from 6 to 18 carbon atoms. Representative examples of such cosurfactants are 3-(butyloxy)-2-hydroxypropyl-β-D-galactopyranoside, 3-(eicosyloxy)-2-hydroxypropyl-β-D-galactopyranoside, 3-(decyloxy)-2-hydroxypropyl-β-D-galactopyranoside, 3-(butyloxy)-2-hydroxypropyl-β-D-glucopyranoside, 3-(octyloxy)-2-hydroxypropyl-β-D-mannopyranoside, 3-(tetradecyloxy)-2-hydroxypropyl-β-D-lactoside, 3-(octadecyloxy)-2-hydroxypropyl-β-D-maltoside, 3-(octyloxy)-2-hydroxypropyl-β-D-galactotrioside, and 3-(dodecyloxy)-2-hydroxypropyl-β-D-cellotrioside.

The polyhydroxy fatty acid amide sugar cosurfactants are generally disclosed in U.S. Pat. Nos. 5,174,927, 5,223,179 and 5,332,528, the entire disclosure of each of which is incorporated herein by reference. The polyhydroxy fatty acid amide surfactant component of the present invention comprises compounds of the structural formula:

$$R^2C(O)N(R^1)Z$$

wherein: $R^1$ is H, $C_1$–$C_4$ hydrocarbyl, 2-hydroxy ethyl, 2-hydroxy propyl or a mixture thereof, preferably $C_1$–$C_4$ alkyl, more preferably $C_1$ or $C_2$ alkyl, most preferably C, alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In the above Formula $R^1$ can be, for example, N-methyl, N-ethyl, N-propyl, N-isopropyl, N-butyl, N-2-hydroxy ethyl, or N-2-hydroxy propyl.

$R^2C(O)N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Representative examples of such cosurfactants are N-methyl-N-1-deoxyglucityl cocoamide and N-methyl-N-1-deoxyglucityl tallowamide.

Other suitable polyhydroxy fatty acid amide cosurfactants (see U.S. Pat. Nos. 5,223,179 and 5,338,491, the entire contents of each of which are incorporated herein by reference) are those of the formula:

$$RC(O)N(R^1)CFCH(OH)CH_2OH$$

wherein R is a $C_7$–$C_{21}$ hydrocarbyl species, i.e. coconut, tallow, palm fatty alkyl and oleyl, and $R^1$ is a $C_1$ to $C_6$ hydrocarbyl or substituted hydrocarbyl species, i.e. N-alkyl-N-(1,2-propanediol) and N-hydroxyalkyl-N-1,2-propane diol fatty acid amides. Representative examples of such cosurfactants are the tallow amide of 3-[2-(hydroxyethyl) amino]-1,2-propanediol (HEAPD), the palmitate amide of 3-methylamino-1,2-propanediol (MAPD) and the lauramide of MAPD.

In a particularly preferred embodiment of the present invention, the sugar surfactant is an alkyl polyglycoside of formula I wherein $R_1$ is a monovalent organic radical having from about 8 to about 18, and most preferably from about 8 to about 16 carbon atoms, b is zero, and a is a number having a value of from about 1 to about 3, and most preferably from 1 to 2.

The alkyl sulfates, and salts thereof, which may be employed as a dye transfer inhibition additive in the present invention are of the formula:

$$RO—(CH_2CH_2O)_n—SO_3$$

wherein R is an alkyl group having from about 8 to about 18 carbon atoms, and preferably from about 12 to about 16 carbon atoms, and n is a number having a value of from 0 to about 10, and preferably from 1 to 3. A particularly preferred alkyl sulfate is sodium lauryl ether sulfate.

The aminocarboxylic acid amphoteric surfactants, and salts thereof, which may be employed as a dye transfer inhibition additive, are of the formulae:

$$R—NH—CH_2CH_2COOH \text{ and } R—N—(CH_2CH_2COOH)_2$$

wherein R is an alkyl group having from about 8 to about 18, and preferably from about 12 to about 16 carbon atoms. A particularly preferred aminocarboxylic acid amphoteric surfactant is sodium N-coco β-aminopropionate.

According to one embodiment of the present invention, the dye transfer inhibition additive is based on a combination of a sugar surf actant, preferably an alkyl polyglycoside and an alkyl ether sulfate, preferably sodium laureth sulfate, and an aminocarboxylic acid amphoteric, preferably sodium N-coco β-aminopropionate, wherein these components are combined in a ratio by weight ranging from about 1:0:0 to about 0:1:0, to about 0:0:1, and preferably about 1:3:1.

According to another embodiment, the dye inhibition additive is added to the detergent composition in an amount ranging from about 0.1 to about 50% by weight, and preferably from about 1 to about 30% by weight, based on the total weight of the detergent composition being formulated. In the event that a powdered detergent is formulated, the dye transfer inhibition additive will preferably be present therein in an amount of from about 1 to about 20% by weight, based on the total weight of the powdered detergent composition. However, if a liquid detergent is employed the amount of additive present therein will be from about 1 to about 10% by weight, based on the total weight of the liquid detergent composition.

The detergent compositions to which the dye transfer inhibition additive may be added will contain an alkali component selected from the group consisting of sodium hydroxide, sodium carbonate monoethanolamine, diethanolamine, triethanolamine, and mixtures thereof. The amount of alkali component present in the detergent composition is typically in the range of from about 0.1 to about 75% by weight, and preferably from about 1 to about 50% by weight, based on the total weight of the detergent composition. However, for powdered detergent composition, the amount of alkali component contained therein will preferably range from about 25 to about 75% by weight, based on the total weight of the powdered detergent composition. Similarly, if a liquid detergent is employed the amount of alkali component present therein will be from about 0.1 to about 10% by weight, based on the total weight of the liquid detergent composition.

The dye transfer inhibition additive may be added to the detergent composition in any known conventional manner such as, for example, by mixing.

According to yet another embodiment of the present invention, there is provided a process for inhibiting the transfer of fugitive dyes onto textile substrates such as, for example, clothes, during the laundering/washing thereof. The process involves contacting the textile substrates, in an aqueous bath, with the above-disclosed dye inhibition additive of the present invention. The contacting step may be performed either by hand in a suitable receptacle or in a conventional washing machine-type apparatus.

The detergent composition employed in the present invention may contain additional constituents, other than the sodium hydroxide component. These additional constituents are well known in the art and may include, for example, anionic surfactants, nonionic surfactant, other than the above-disclosed sugar surfactant, anionic surfactants, other than alkyl ether sulfates, builders, foam stabilizers, anti-redeposition polymers, optical brighteners, peroxygen bleaches, perfumes, and the like.

Textile substrates are defined as any articles of manufacture made from textiles. Examples include, but are not limited to, clothing, carpeting, linen and the like.

The present invention will be better understood from the examples which follow, all of which are meant to be illustrative only and are not meant to unduly limit the scope of the invention in any way. Unless otherwise indicated, percentages are on a weight-by-weight basis.

Test Procedure

Various surfactants and polymers were evaluated using the screening protocol outlined below.

1. The surfactants and polymers were tested at a concentration of 250 ppm.
2. The dyes tested were Blue Direct Dye #1 and Acid Red Dye 151 at concentrations of 1 and 10 ppm.
3. The test solution had a pH of 10.5±0.1.
4. The water hardness of the test solution was 150 ppm (3:2) Ca:Mg.

A liter of test solution was placed in a tergotometer pot with two 4×6 inches of bleached, desized print cloth cotton swatches placed therein. The test solution was stirred for 10 min. at 100 rpm at 80° F.±2F. At the end of the wash cycle, the swatches were removed, squeezed by hand and stirred in a liter of tap water for two minutes. After rinsing, the swatches were again squeeze-dried by hand and air dried at an ambient temperature. Afterwards, their reflectance was measured with a "Hunter Lab Colorquest" spectrophotometer. The reported values are the ΔR difference between the initial and final reflectance reading of the swatches.

Direct Blue Dye #1, at a concentration of 1 ppm was first tested, per the above procedure, using various surfactants and polymers at a concentration of 250 ppm, at a pH of 10.7 with NaOH as the alkali. The results thereof are found in Table 1, below. (B=dimension of blueness in the Lab scale)

TABLE 1

| Surfactant/Polymer | ΔB |
|---|---|
| GENAPOL ® 26L-50 | −10.1 |
| SURFONIC ® N-95 (NP-9) | −10.2 |
| GLUCOPON ® 220 UP | −9.6 |
| GLUCOPON ® 625 UP | −6.9 |
| STANDAMID ® SD | −13.1 |
| STANDAPOL ® TG4-SLES | −5.9 |
| DERIPHATES ® 151C | −6.7 |
| Linear alkyl benzene sulfonate | −11.8 |
| VELVETEX ® BA-35 | −8.5 |
| PVP ® K-30 | −10.0 |
| PVP ® K-90 | −10.0 |
| POLYMER HSP-1180 | −5.4 |
| ACUSOL ® 505N | −6.7 |
| NATROSOL ® 250 MR | −6.5 |
| GANTREZ ® AN 119 | −17.7 |

TABLE 1-continued

| Surfactant/Polymer | ΔB |
|---|---|
| Water | −13.4 |

1. PVP ® = polyvinyl pyrrolidone commercially available from ISP.
2. GENAPOL ® = an ethoxylated alcohol commercially available from Hoechst Corp.
3. SURFONIC ® = an ethoxylated nonylphenol commercially available from Texaco Chemical Co.
4. GLUCOPON ® 220 UP = an alkyl polyglycoside commercially available from Henkel Corp.
5. GLUCOPON ® 625 UP = an alkyl polyglycoside commercially available from Henkel Corp.
6. STANDAMID ® SD = an alkanolamide commercially available from Henkel Corp.
7. STANDAPOL ® = an alcohol ether sulfate commercially available from Henkel Corp.
8. DERIPHATES ® = an aminocarboxylic acid amphoteric commercially available from Henkel Corp.
9. VELVETEX ® = a betaine commercially available from Henkel Corp.
10. ACUSOL ® = acrylic polymer available from Rohm & Haas Co.
11. NATROSOL ® = hydroxy ethyl cellulose available from Aqualon Inc.
12. GANTREX ® = poly(methyl) vinyl ether/maleic anhydride copolymer available from ISP.
13. POLYMER HSP-1180 = Polyacrylo-amido-methyl-propane sulfonic acid.

As can be seen from the data in Table 1, of the various nonionic surfactants tested, GLUCOPON® 625 UP exhibited the most effective dye transfer inhibition. Of the various anionic surfactants tested, STANDAPOL® TG4-SLES exhibited the most effective dye transfer inhibition.

Acid Red 151 was then tested at a concentration of 1 ppm, per the above procedure, using various surfactants and polymers at a concentration of 250 ppm, at a pH of 10.5±0.2 with NaOH as the alkali. The results thereof are found in Table 2, below. (A=dimension of redness in the Lab scale)

TABLE 2

| Surfactant/Polymer | ΔA |
|---|---|
| GENAPOL ® 26L-50 | 11.4 |
| SURFONIC ® N-95 (NP-9) | 9.5 |
| GLUCOPON ® 220 UP | 8.8 |
| GLUCOPON ® 625 UP | 8.4 |
| STANDAMID ® SD | 12.2 |
| STANDAPOL ® TG4-SLES | 5.5 |
| DERIPHATES ® 151C | 7.5 |
| Linear alkyl benzene sulfonate | 8.3 |
| VELVETEX ® BA-35 | 8.2 |
| PVP ® K-30 | 12.2 |
| PVP ® K-90 | 15.9 |
| POLYMER HSP-1180 | 10.4 |
| ACUSOL ® 505N | 5.2 |
| NATROSOL ® 250 MR | 6.3 |
| GANTREZ ® AN 119 | 18.2 |
| Water | 15.4 |

As can be seen from the data in Table 2, GLUCOPON® 625 UP exhibited more effective dye transfer inhibition than the ethoxylated or nonylphenol. Similarly, STANDAPOL® TG4-SLES and DERIPHAT® 151C exhibited more effective dye transfer inhibition than the linear alkyl benzene sulfonate.

What is claimed is:

1. A detergent composition consisting essentially of:

(a) an alkali component selected from the group consisting of sodium hydroxide, sodium carbonate, monoethanolamine, diethanolamine, triethanolamine, and mixtures (b) a dye transfer inhibition additive consisting of a mixture of:

(i) a sugar surfactant selectee from the group consisting of an alkyl polyglycoside having general formula (I)

$$R_1O(Z)_a \quad I$$

wherein $R_1$ is a monovalent organic radical having from about 6 to about 30 carbon atoms; Z is a saccharide residue having 5 or 6 carbon atoms; a is a number having a value from 1 to about 6, an alkyl glucose ester, an aldobionamide, a gluconamide, a glyceramide, a glyceroglycolipid, a polyhydroxy fatty acid amide and mixtures thereof;

(ii) an alkyl ether sulfate; and (iii) an aminocarboxylic acid amphoteric surfactant.

2. The composition of claim 1 wherein the sugar surfactant is an alkyl polyglycoside of formula I wherein in formula I, $R_1$ is a monovalent organic radical having from about 8 to about 16 carbon atoms, and a is a number having a value of from about 1 to about 3.

3. The composition of claim 1 wherein the sugar surfactant is a polyhydroxy fatty acid amide.

4. The composition of claim 1 wherein the alkyl ether sulfate is sodium lauryl ether sulfate.

5. The composition of claim 1 wherein the dye inhibition additive is a mixture of an alkyl polyglycoside, an alkyl ether sulfate and an aminocarboxylic acid amphoteric surfactant in a ratio by weight of 1:3:1.

6. The composition of claim 1 wherein the alkali component is present in the composition in an amount of from about 0.1 to about 75% by weight, based on the weight of the composition.

7. The composition of claim 1 wherein the dye transfer inhibition additive is present in the composition in an amount ranging from about 0.1 to about 50% by weight, based on the weight of the composition.

8. The composition of claim 1 further comprising an additive selected from the group consisting of nonionic surfactants, other than sugar surfactants, anionic surfactants, other than alkyl ether sulfates, builders, foam stabilizers, perfumes and mixtures thereof.

9. A process for inhibiting the transfer of fugitive dyes onto textile substrates, during laundering, comprising contacting the textile substrates, in an aqueous bath, with a dye transfer inhilition additive consisting of a mixture of:

(i) a sugar surfactant selected from the group consisting of an alkyl polyglycoside having general formula (I)

$$R_1O(Z)_a \quad I$$

wherein $R_1$ is a monovalent organic radical having from about 6 to about 30 carbon atoms; Z is a saccharice residue having 5 or 6 carbon atoms; a is a number having a value from 1 to about 6, an alkyl glucose ester, an aldobionamide, a gluconamide, a glyceramide, a glyceroglycolipid, a polyhydroxy fatty acid amide and mixtures thereof;

(ii) an alkyl ether sulfate; and (iii) an aminocarboxylic acid amphoteric surfactant.

10. The process of claim 9 wherein the sugar surfactant is an alkyl polyglycoside of formula I wherein in formula I, $R_1$ is a monovalent organic radical having from about 8 to about 16 carbon atoms, and a is a number having a value of from about 1 to about 3.

11. The process of claim 9 wherein the sugar surfactant is a polyhydroxy fatty acid amide.

12. The process of claim 11 wherein the alkyl ether sulfate is sodium lauryl ether sulfate.

13. The process of claim 9 wherein the dye inhibition additive is a mixture of an alkyl polyglycoside, an alkyl ether sulfate and an aminocarboxylic acid amphoteric surfactant in a ratio by weight of 1:3:1.

14. The process of claim 9 wherein the aqueous bath further contains a detergent composition comprising an alkali component selected from the group consisting of sodium hydroxide, sodium carbonate, monoethanolamine, diethanolamine, triethanolamine, and mixtures thereof.

15. The process of claim 14 wherein the alkali component is present in the detergent composition in an amount of from about 0.1 to about 75% by weight, based on the weight of the detergent composition.

16. The process of claim 14 wherein the dye transfer inhibition additive is present in the detergent composition in an amount ranging from about 0.1 to about 50% by weight, based on the weight of the composition.

17. The process of claim 14 wherein the detergent composition further comprises an additive selected from the group consisting of nonionic surfactants, other than sugar surfactants, anionic surfactants, other than alkyl ether sulfates, builders, foam stabilizers, perfumes and mixtures thereof.

* * * * *